United States Patent [19]

Meunier et al.

[11] 3,984,230

[45] Oct. 5, 1976

[54] AGGLOMERATION OF ORE BY SINTERING

[75] Inventors: Henry Gilbert Meunier; Georges Victor Rolf, both of Liege, Belgium

[73] Assignee: Centre de Recherches Metallurgiques-centrum voor Research in de Metallurgie, Brussels, Belgium

[22] Filed: May 9, 1974

[21] Appl. No.: 468,571

[30] Foreign Application Priority Data

| | | |
|---|---|---|
| May 11, 1973 | Belgium | 799457 |
| Dec. 19, 1973 | Belgium | 808856 |
| Dec. 19, 1973 | Belgium | 808857 |

[52] U.S. Cl. ..... 75/5; 75/3

[51] Int. Cl.[2] ..... C22B 1/16; C22B 1/08

[58] Field of Search ..... 75/3–5

[56] References Cited

UNITED STATES PATENTS 3,489,550 1/1970 Anderson ..... 75/5

*Primary Examiner*—Peter D. Rosenberg

*Attorney, Agent, or Firm*—Holman & Stern

[57] ABSTRACT

A combustible bed of ore is formed on a sinter grate, which may form part of a sinter strand. Holes are pierced through the bed before ignition. Combustion-supporting gas is passed through the ignited bed to cause a combustion front to pass through the bed. The bed can be pierced by piercing members carried by a reciprocal frame on a carriage moving parallel to the sinter strand.

16 Claims, 6 Drawing Figures

AGGLOMERATION OF ORE BY SINTERING

BACKGROUND OF THE INVENTION

The present invention relates to a method for carrying out the agglomeration of ore on a sintering grate, and especially for the agglomeration of iron ore to be included in the charge of shaft furnaces such as blast furnaces.

The production of agglomerates on a sintering grate usually comprises the following steps:

preparation of a mixture of ore, solid fuel (such as coke), fines, various additives (such as fluxes), and water;

formation of a bed or layer of this mixture on the grate, being either fixed or given a translation motion, a vacuum being applied to its lower side;

ignition of the bed of mixture at its upper surface, which results in a combustion front passing downwards through the whole bed; and unloading of the agglomerate (sinter).

When the grate is given translational motion it may form part of a sinter strand consisting of a series of such grates passing under an ignition hood and over a suction box.

The factors substantially affecting the sintering rate, i.e., the time spent by the combustion front in moving from the upper surface of the bed down to the grate supporting the mixture, are vacuum level, depth of the bed, and air permeability of the mixture.

The possibility of increasing the vacuum level, which results in a higher sintering rate, is limited, for the cost of the energy used by the suction fan and the cost of providing conduits and suction boxes capable of withstanding greatly reduced pressures soon become prohibitive. Furthermore, sealing problems which are difficult to overcome are encountered at very low pressures.

The depth of the bed cannot be increased above a given level, because the resulting deterioration in the quality of the agglomerate has to be compensated for by excessive coke consumption.

The permeability of the mixture on the other hand must be as high as possible but compatible with the required quality of the agglomerate.

The factors influencing this permeability are substantially as follows:

the characteristics of the ores and accompanying materials: it is advantageous to choose suitable materials;

the proportion of return fines in the mixture: permeability is increased when the level of return fines is increased, but the quantity of usable agglomerate decreases; accordingly there is an optimum proportion of return fines in the mixture, at which the productivity is maximized;

the method of preparing the mixture, and in particular the way in which water is added: the kinds of mixers, grinders, etc. have to be carefully chosen;

the way in which the mixture is charged onto the grate: it is important to reduce any phenomenon causing segregation or compaction (e.g., dropping);and the regulation of the amount of water added to the mixture; we have already proposed a method of controlling the permeability by regulating the rate of addition of water to the mixture before the mixture is charged onto the grate, in order to obtain the optimum permeability of the sinter bed, i.e., the highest possible permeability consistent with the required quality for the agglomerate.

SUMMARY OF THE INVENTION

The present invention relates to a way of increasing the permeability of the sinter bed and thus increasing the average sintering rate by suitably altering the structure of the sinter bed.

The invention provides a method of producing an agglomerate of ore by sintering, comprising forming a combustible bed of ore on a sinter grate, piercing substantially vertical holes through the bed, igniting the pierced bed, and passing combustion-supporting gas through the ignited bed to cause a combustion front to travel through the bed.

In a preferred method according to the present invention, by means of points (e.g., pins) arranged above the bed (and, if necessary, moving parallel to and together with the grate at substantially the same speed) substantially vertical holes are formed in the bed throughout the thickness of the bed, the perforating points being kept moving after their penetration into the mixture, and the perforated mixture to be agglomerated is ignited by means of a burner.

The displacement of the points parallel to the grate enables precise holes to be formed since relative movement between the perforating points and the bed is prevented while the perforating points are in contact with the bed.

In order to effect perforation, a support for the perforating points is moved towards the bed until these points penetrate the bed and reach the lower surface of the bed; and the support is moved away in the opposite direction until complete disengagement of the points is attained.

A close examination of sinter beds has revealed that in certain cases an irregular distribution of the permeability occurs across the bed, i.e., the permeability is higher in the zone located at the edge of the bed and is remarkably lower at its center. In such cases, it may be particularly advantageous to pierce only the central zone of the bed.

The surface layer of the bed may be compacted in order to improve firing. Compaction preferably takes place to a depth of the order of 5 to 10 mm.

For the sake of uniformity, the perforating points are preferably arranged in staggered rows.

It is convenient for the diameter of the holes formed by the piercing operation to be from 1 to 10 mm, preferably 5 mm. The distance between the vertical axes of the holes formed in the bed may be from 10 to 50 mm and is preferably about 30 mm. The results attained by forming such holes in the sinter bed have been very satisfactory, since it has been found that there is a productivity increase of the order of 20 to 25% with respect to an unperforated bed.

The achievement of the required properties of the agglomerate is preferably ensured by control of the quantity of solid fuel present in the mixture to be agglomerated, which results, for example, in finding of minimum consumption of solid fuel for a given quality of the agglomerate. To this end it has already been suggested to reduce the consumption of coke by replacing part of the solid fuel present in the mixture by a given quantity of gaseous fuel supplied to the surface of the mixture in order to heat the mixture. The advantage of this replacement is that the gaseous fuel can be chosen for its availability or its low cost, for example.

However, such replacement of the fuel in the charge by a gaseous fuel, supplied to the surface of the sinter bed to heat it, sometimes causes irregularities in firing and in propagation of the combustion front.

To overcome this drawback, in the method according to the present invention, after piercing of the bed has been carried out but before the ignition of the bed, the bed is pre-heated by hot gas whose temperature and oxygen content are insufficient to cause ignition of the solid fuel in the bed.

In the most frequent case in which the grate is given translational motion, the mixture to be sintered is poured onto the leading end of the grate, holes are pierced in the bed upstream of a pre-heating system in which the pierced section is heated by hot gas, and pre-heating is terminated immediately before the section of the bed reaches the region where the ignition of the bed takes place.

Pre-heating may be carried out by means of at least one burner, with or without supplying hot gas, which preferably is recycled gas such as the hot gas recovered from the cooler usually located at the outlet of the sinter grate.

In pre-heating, the hot gas may be blown from below upwards through the bed of material to be sintered.

If above all a reduction in the consumption of solid fuel is desired, the pre-heating method described above is the more advantageous the greater the depth of the bed.

The method according to the present invention has the great advantage of ensuring production of good quality agglomerates without in any way impairing the productivity of the sintering plant. Indeed the piercing of holes results in an increase of the permeability of the bed and accelerates heat exchanges during pre-heating.

In order to further decrease the consumption of solid fuel, for the same agglomerate quality and without adversely affecting the productivity of the plant, it is advantageous to additionally heat the perforated mixture, after ignition, by means of hot combustion-supporting gas containing sufficient oxygen for effecting the combustion of the fuel contained in the mixture. The additional heating may be carried out by means of at least one burner, the combustion occurring in the presence of air or air enriched with oxygen or even industrially pure oxygen. It should be noted that combustion in the presence of air yields gas having a temperature substantially lower (owing to ballast nitrogen) than that of the hot gas obtained as a result of a combustion in the presence of oxygen-enriched air or pure oxygen. This situation allows control of the temperature of the additional heating gas by suitable dilution of pure oxygen with air so as to maintain this temperature at a level lower than the melting point of the agglomerate.

Additional heating may also be carried out by supplying hot gas obtained from heating either in a suitable heat exchanger, such as a Cowper stove, or in a recuperator, such as that comprising the cooler usually arranged at the outlet of the agglomeration grate.

A device for carrying out the above-described method of piercing the bed comprises:

a. a carriage arranged to move along a path parallel to the sinter strand, at least upstream of the place where the sintered bed is ignited, the carriage being above the strand, upstream of the ignition point;
b. a moving frame having a substantially horizontal base in which a number of holes are formed, the frame being supported by the carriage and being slidable, preferably vertically, in suitable grooves formed in the carriage;
c. elongate piercing members or perforating points (in the form of pins or rods, for example) designed to be placed in the holes in the base of the moving carriage, each point having an enlarged upper end or head which prevents withdrawal of the point from the frame;
d. means for causing the frame to slide vertically in the carriage; and
e. means (such as weights or springs) for maintaining the enlarged upper ends or heads of the perforating points in engagement with the base of the frame as the points pierce the bed.

The carriage is advantageously provided with wheels on which it moves parallel to the sinter strand.

The means for maintaining the heads of the perforating points in engagement with the base of the frame are preferably releasable in order to terminate the penetration of the points into the bed when excessive resistance is encountered which might damage the points.

It has been found advantageous for the means for maintaining the heads of the points in engagement with the base of the frame to comprise a catch system, such as one of the ball and spring type, whose action is exerted perpendicular to the displacement direction of the perforating point.

The perforating point may be mounted on a support which can move, preferably vertically, under the action of means independent of those causing the displacement of the moving frame.

In a particularly favorable embodiment of the device the amplitude of the downward sliding movement of the frame is such that at the end of its stroke it contacts the bed and preferably applies sufficient compression to this bed to prevent any carrying away of material upon withdrawal of the points and to make the subsequent ignition easier.

The means employed for causing the frame to slide vertically in the carriage are advantageously such that the moving down and up speeds of the frame are high relative to the displacement speed of the sinter strand.

Various means can be devised for carrying out this vertical alternating movement. Use can be made of a device comprising a quick-return pneumatic jack. A preferred device, however, is an eccentric or cam having a stroke amplifier for example, which allows high speeds to be reached quickly.

BRIEF DESCRIPTION OF THE DRAWINGS

The invention will be described further, by way of example only, with reference to the accompanying drawings, in which.

DETAILED DESCRIPTION OF THE PREFERRED EMBODIMENT

Figure 1:
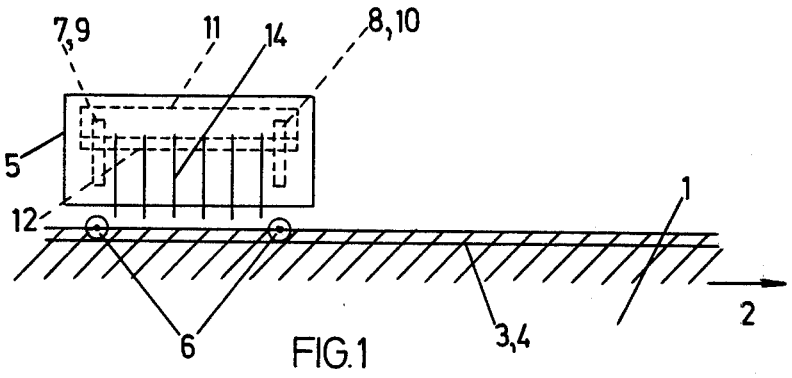
FIG. 1 is an elevational view of a device for piercing a sinter bed in a sinter plant.
Figure 2:
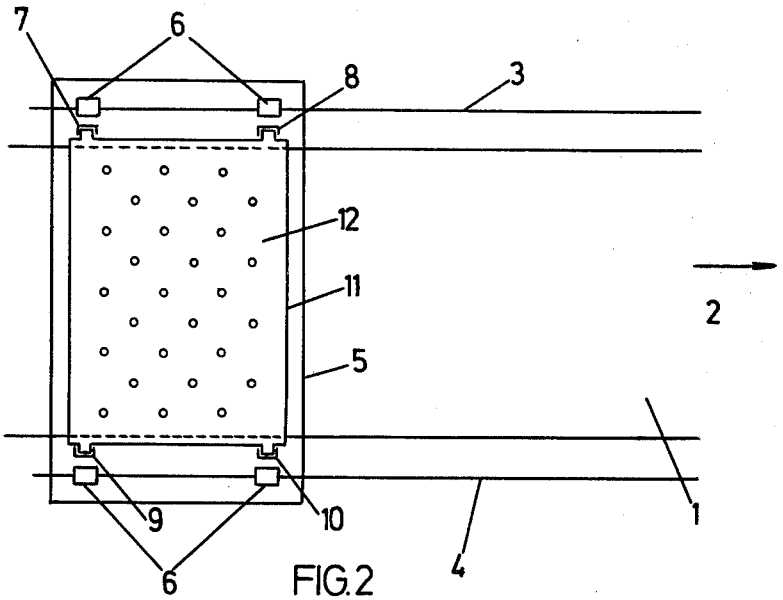
FIG. 2 is a plan view of the device.
Figure 3:
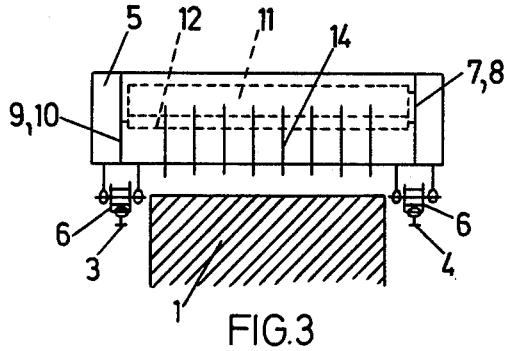
FIG. 3 is a side view of the device.
Figure 4:
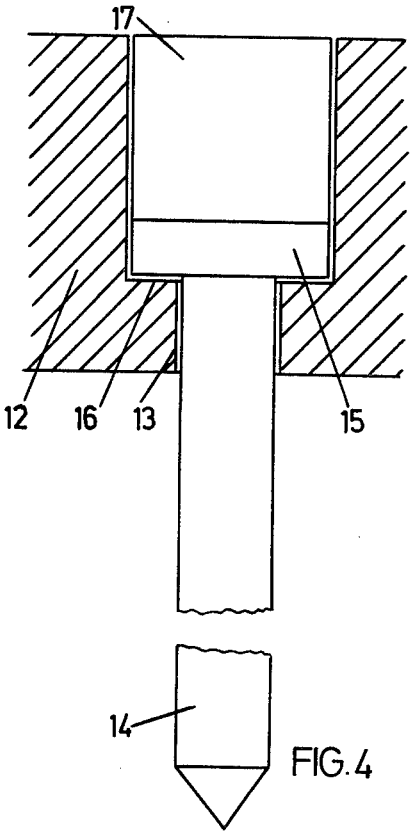
FIGS. 4 to 6 show three alternative embodiments of a detail of FIG. 3 on an enlarged scale.
Figure 5:
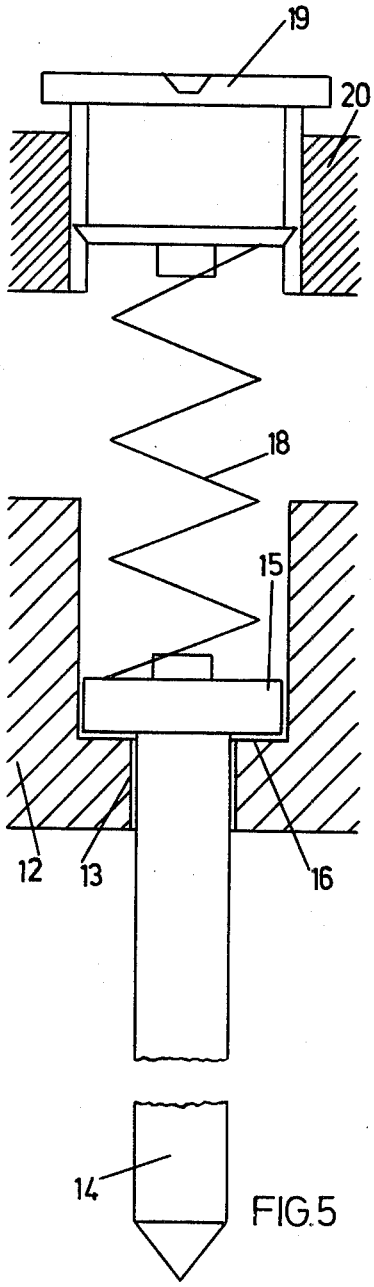
Figure 6:
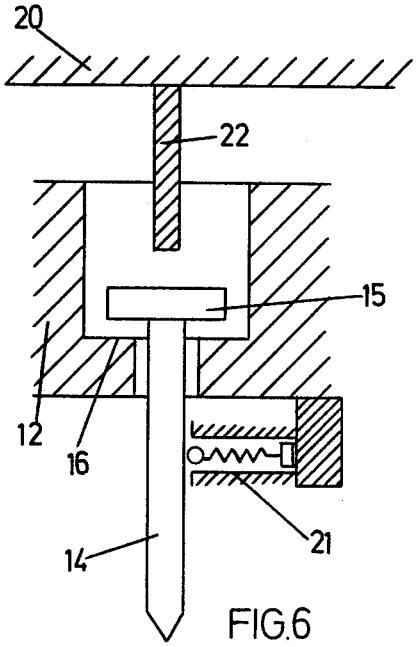

In the sintering installation, a sintering grate or strand 1 moves in the direction indicated by the arrow 2 at a given speed. A rolling path is provided along the strand by a pair of rails 3 and 4 flanking the strand. A carriage 5 moves along this rolling path on wheels or rollers 6. The carriage 5 has vertical sliding guides 7, 8, 9 and 10 along which a frame 11 can slide upwards or downwards, this frame being substantially rectangular in shape. The frame 11 has a base 12 having a number of vertical stepped passages 13 (FIGS. 4 to 6) each of which receives an elongate piercing member or pin 14. Each pin 14 has a head 15 resting against the shoulder 16 defined by the stepped passage 13. Each pin 14 is held down (i.e., against the shoulder 16) either by a weight 17 (FIG. 4), or by an adjustable compression spring 18 (FIG. 5) reacting through a threaded plug 19 against a plate 20 acting as an upper wall for the frame 11, or by a catch system 21 (such as the ball and spring type, FIG. 6). With the catch system should a pin encounter an excessive resistance to its penetration, into the sinter bed, it is automatically stopped when the frame 11 is raised again, the pin will move upwards with the frame, thus maintaining with respect to the base of the frame the same relative position as that which it occupied when it was stopped. A lug 22 fixed above the pin will limit the upward movement of the pin and will return it again to its original position for starting a new cycle.

The operation of the device is simple. The carriage 5 is moved in the direction indicated by the arrow 2 at a speed equal to that of the sinter strand 1 either by an independent device or by a driving device powered or controlled by that moving the strand, such as a magnetically operated one. During this period, the frame 11 provided with its pins 14 moves downwards, until the pins have penetrated into and passed through the bed of materials to be sintered; after this the frame is withdrawn together with its pins; an entire section of the bed on the strand thus has perforations formed therein (the upper surface of this region is subsequently ignited). The carriage is then moved backwards and the piercing process starts again on the next section.

We claim:

1. A method of producing an agglomerate of ore by sintering, comprising the sequential steps of: forming a combustible bed of ore on a sinter grate; piercing substantially vertical holes through the bed prior to igniting the bed, whereby the gas permeability of the bed is increased; pre-heating the bed by means of hot gas whose temperature and oxygen content are insufficient to cause ignition of the bed; igniting the bed; and passing combustion-supporting gas through the ignited bed to cause a combustion front to travel through the bed.

2. The method as claimed in claim 1, including compacting the upper layer of the bed before ignition.

3. The method as claimed in claim 2, in which the said upper layer is 5 to 10 mm thick.

4. The method as claimed in claim 1 in which the diameter of the holes is from 1 to 10 mm.

5. The method as claimed in claim 1, in which the distance between the longitudinal axes of the holes is from 10 to 50 mm.

6. The method as claimed in claim 1, including moving the grate along a given path, beginning the formation of the bed at the leading end of the grate, piercing the bed upstream of a system for pre-heating the bed, pre-heating the bed in the system, and terminating pre-heating immediately before a location at which the ignition of the bed is performed.

7. The method as claimed in claim 1, in which the pre-heating comprises heating by means of a burner.

8. The method as claimed in claim 1, in which the hot gas used for pre-heating is gas recovered from a cooler arranged to cool the agglomerate formed.

9. The method as claimed in claim 1, in which the pre-heating comprises blowing of hot gas upwards through the bed.

10. The method as claimed in claim 1, including, after ignition, additionally heating the bed by means of hot combustion-supporting gas containing sufficient oxygen to ensure combustion of the bed.

11. The method as claimed in claim 10, in which the additional heating comprises heating by means of at least one burner.

12. The method as claimed in claim 11, in which the combustion occurs in the presence of industrially pure oxygen.

13. The method as claimed in claim 12, including controlling the temperature of the additional heating by diluting the pure oxygen with air so as to maintain this temperature at a level lower than the melting point of the aggregate.

14. The method as claimed in claim 12, in which the hot gas is obtained by a heating in a heat exchanger.

15. The method as claimed in claim 10, in which the hot gas is obtained from a heating operation in a heat exchanger.

16. The method as claimed in claim 15, in which the heat exchanger is a cooler for cooling the agglomerate formed.

* * * * *